US009492801B2

(12) United States Patent
Vesala

(10) Patent No.: US 9,492,801 B2
(45) Date of Patent: Nov. 15, 2016

(54) METHOD AND APPARATUS FOR MIXING A FIRST FLUID WITH A SECOND FLUID IN A MIXING CHAMBER CONNECTED TO A TURBINE CHAMBER

(75) Inventor: Reijo Vesala, Kotka (FI)

(73) Assignee: Sulzer Management AG, Winterthur (CH)

( * ) Notice: Subject to any disclaimer, the term of this patent is extended or adjusted under 35 U.S.C. 154(b) by 1147 days.

(21) Appl. No.: 12/811,808

(22) PCT Filed: Jan. 8, 2009

(86) PCT No.: PCT/EP2009/050174

§ 371 (c)(1),
(2), (4) Date: Jul. 6, 2010

(87) PCT Pub. No.: WO2009/087193

PCT Pub. Date: Jul. 16, 2009

(65) Prior Publication Data

US 2010/0278664 A1 Nov. 4, 2010

(30) Foreign Application Priority Data

Jan. 11, 2008 (EP) ..... 08100386

(51) Int. Cl.
*B01F 7/00* (2006.01)
*D21B 1/34* (2006.01)
*B01F 15/00* (2006.01)

(52) U.S. Cl.
CPC ..... *B01F 7/00908* (2013.01); *B01F 7/00916* (2013.01); *D21B 1/342* (2013.01); *B01F 15/00545* (2013.01); *B01F 2215/0078* (2013.01)

(58) Field of Classification Search
CPC ..... B01F 7/00916; B01F 7/00908; B01F 15/00545; B01F 2215/0078; D21B 1/342
USPC ..... 366/168.2, 172.1, 172.2
See application file for complete search history.

(56) References Cited

U.S. PATENT DOCUMENTS 1,054,534 A * 2/1913 Griffin ..... 366/168.2
3,366,367 A * 1/1968 Tofte ..... 366/270

(Continued)

FOREIGN PATENT DOCUMENTS

DE 930 517 C 7/1955
EP 1586366 A1 * 10/2005

(Continued)

OTHER PUBLICATIONS

Specification in U.S. Appl. No. 12/217,403 to Morgenthaler.*

(Continued)

*Primary Examiner* — Charles Cooley
(74) *Attorney, Agent, or Firm* — Kilpatrick Townsend & Stockton LLP

(57) ABSTRACT

A method and an apparatus for mixing a first fluid with a second fluid.
The apparatus has a mixing chamber, and a turbine chamber. The mixing chamber has a mixer rotor, and an inlet channel, through which the first fluid is introduced from a pipeline. The turbine chamber has an inlet conduit for the second fluid, and a turbine wheel, connected operatively to the mixer rotor. The first fluid is introduced into the mixing chamber from the pipeline. The second fluid is introduced into the turbine chamber to thereby rotate the turbine wheel by a motive force of the second fluid. The rotation of the turbine wheel imparts rotation to the mixer rotor, thus affecting the mixing of the second fluid into said first fluid. The second fluid is discharged from the turbine chamber to the mixing chamber, where the first and second fluids are mixed.

8 Claims, 5 Drawing Sheets

(56) References Cited

U.S. PATENT DOCUMENTS

| | | | | |
|---|---|---|---|---|
| 4,093,506 | A | 6/1978 | Richter | |
| 5,279,709 | A * | 1/1994 | Niskanen | 162/52 |
| 5,320,500 | A | 6/1994 | Cholet | |
| 5,466,334 | A * | 11/1995 | Fredriksson et al. | 162/56 |
| 5,791,778 | A * | 8/1998 | Manninen et al. | 366/171.1 |
| 6,193,406 | B1 * | 2/2001 | Peltonen et al. | 366/168.2 |
| 6,309,096 | B1 * | 10/2001 | Chang | 366/143 |
| 9,339,777 | B2 * | 5/2016 | Vesala | B01F 7/00175 |
| 2001/0006484 | A1 * | 7/2001 | Peltonen et al. | 366/168.2 |
| 2004/0013032 | A1 * | 1/2004 | Cappellino | 366/172.2 |
| 2008/0130400 | A1 * | 6/2008 | Vesala | 366/133 |
| 2009/0016153 | A1 * | 1/2009 | Morgenthaler | 366/155.1 |
| 2010/0278664 | A1 * | 11/2010 | Vesala | 417/405 |
| 2015/0314252 | A1 * | 11/2015 | Vesala | B01F 7/00175 366/279 |

FOREIGN PATENT DOCUMENTS

| | | | |
|---|---|---|---|
| GB | 793275 | A | 4/1958 |
| GB | 875080 | A | 8/1961 |
| JP | 53-146365 | A | 12/1978 |
| JP | 56-058528 | A | 5/1981 |
| JP | 57-35736 | U | 7/1982 |
| JP | 2007-532300 | A | 11/2007 |
| SU | 967536 | A1 | 10/1982 |
| SU | 1228884 | A1 | 7/1986 |

OTHER PUBLICATIONS

Specification in U.S. Appl. No. 60/958,911 to Morgenthaler.*

Office Action for Japanese Application No. 2010-541782. Date mailed Dec. 14, 2012. 4 pages.

* cited by examiner

- -PRIOR ART- -

METHOD AND APPARATUS FOR MIXING A FIRST FLUID WITH A SECOND FLUID IN A MIXING CHAMBER CONNECTED TO A TURBINE CHAMBER

CROSS-REFERENCES TO RELATED APPLICATIONS

This application is a National Stage of International Application No. PCT/EP2009/050174 filed Jan. 8, 2009, and which claims the benefit of European Patent Application No. 08100386.5, filed Jan. 11, 2008, the disclosures of which are incorporated in their entirety by reference.

BACKGROUND OF THE INVENTION

The present invention relates to a method and an apparatus for mixing a fluid with a liquid medium. Specifically, the present invention discloses a method and an apparatus by means of which a fluid is mixed with a liquid medium such that the mixer apparatus need not necessarily be provided with a drive motor at all, in other words at least a part of the power needed to drive the rotor is arranged by using a fluid to rotate the rotor of the mixer.

The majority of prior art mixing devices are either static mixers, which have no moving parts, or dynamic mixers, which have a rotor rotating in a mixing chamber, the rotor being driven by means of a drive unit, normally an electric motor. From time to time such dynamic mixing devices appear on the market that have no drive unit. What makes the use of such devices possible is that sometimes the kinetic energy of a medium entering the mixing chamber is utilised, by means of a specifically designed rotor, to rotate the mixer rotor.

An example of such mixing devices has been disclosed in U.S. Pat. No. 6,193,406. The US-patent discusses a method and an apparatus for mixing different chemicals, both liquid and gaseous, or steam into pulp suspension in the wood processing industry. In the method and the apparatus according to the patent, the pulp suspension and the fluid medium are fed into a mixer casing, mixed therein by means of a freely rotatable mixer rotor and removed from the casing. The freely rotatable mixer rotor provided with mixing blades is placed within the casing and made to rotate by means of incoming flow of pulp suspension being in contact with the mixing blades of the rotor. The fluid medium i.e. the medium to be mixed with the fiber suspension is introduced into the pulp flow either upstream of the mixer casing or directly into the mixer casing in the effective area of the rotating rotor. Thus, both the mixer rotor and the mixing chamber have been designed such that the fiber suspension entering the mixing chamber rotates the rotor. In other words, the mixing function takes place simultaneously and in the same cavity as the rotating function.

However, arranging the rotating of the rotor in the same cavity with the mixing of the two or more media brings about problems, as the requirements set for the cavity by the mixing function are different from the requirements set by the rotating function. Since the rotating of the rotor should be affected by as low use of energy as possible, and since the mixing should be performed as efficiently as possible, it is practically impossible to develop an apparatus that could fulfil simultaneously the requirements of both tasks.

Another problem of this type of a mixer appears when a gaseous substance is intended to be mixed with a liquid. Normally, when mixing gas and liquid, the rotor has to be designed such that the rotor prevents the accumulation of gas in the center of the mixing chamber. This is achieved by arranging the rotor to affect a strong turbulence field in the mixing chamber such that powerful flow components in radial direction are created. However, to be able to perform the above described function the design of the rotor vanes is far from ideal in view of rotating the rotor. Thus, if a major task of the rotor vanes is to rotate the rotor, the design of the rotor vanes is such that the radial force field they are able to create is substantially weak, which results in that the rotor rotates at least partially in a gas bubble, and, as a result, the rotor is not able to mix the gaseous substance efficiently in the liquid.

BRIEF SUMMARY OF THE INVENTION

Thus an object of the present invention is to overcome at least some of the problems of the prior art mixing devices, and to offer a dynamic mixer, which can be designed to match the different requirements set, on the one hand, by the mixing function, and, on the other hand, by the turbine function i.e. the rotating function.

Above objects can be fulfilled by means of a novel dynamic mixer device, which has different chambers for rotating the mixer rotor and for mixing the media.

Thus above objects can be fulfilled by a method of mixing a fluid into a medium in an apparatus comprising a housing having an inlet channel with an inlet opening for said medium; an outlet channel with an outlet opening for a mixture of said medium and said fluid; a mixing chamber between said channels; and a mixer rotor having a shaft arranged in the mixing chamber, the method comprising introducing said fluid and said medium into said mixing chamber, and rotating said mixer rotor in said mixing chamber for mixing said fluid in said medium, the method further comprising the steps of:

- Arranging a turbine chamber in operative communication with said mixing chamber,
- Arranging a turbine wheel in said turbine chamber,
- connecting said turbine wheel operatively to said mixer rotor,
- Introducing a drive fluid in said turbine chamber for rotating said turbine wheel,
- whereby the rotation of the turbine wheel imparts rotation to the mixer rotor affecting the mixing of the fluid into said medium.

Above object can also be fulfilled by an apparatus for mixing a fluid in a medium, said apparatus comprising a housing having, for said medium, an inlet channel with an inlet opening for the medium; an outlet channel with an outlet opening for the mixture of said medium and said fluid; a mixing chamber between said channels; and a mixer rotor in the mixing chamber, the apparatus comprising a turbine chamber arranged in operative communication with said mixing chamber, the turbine chamber having an inlet conduit and an outlet conduit for a drive fluid, and a turbine wheel arranged rotatably within said turbine chamber and being operatively connected with said mixer rotor.

The other characterizing features of the method and apparatus of the present invention will be apparent from the appended claims.

BRIEF DESCRIPTION OF THE DRAWINGS

The method and apparatus in accordance with the present invention are described in more detail below, by way of example, with reference to the enclosed drawings: of which

DETAILED DESCRIPTION OF THE INVENTION

Figure 1:
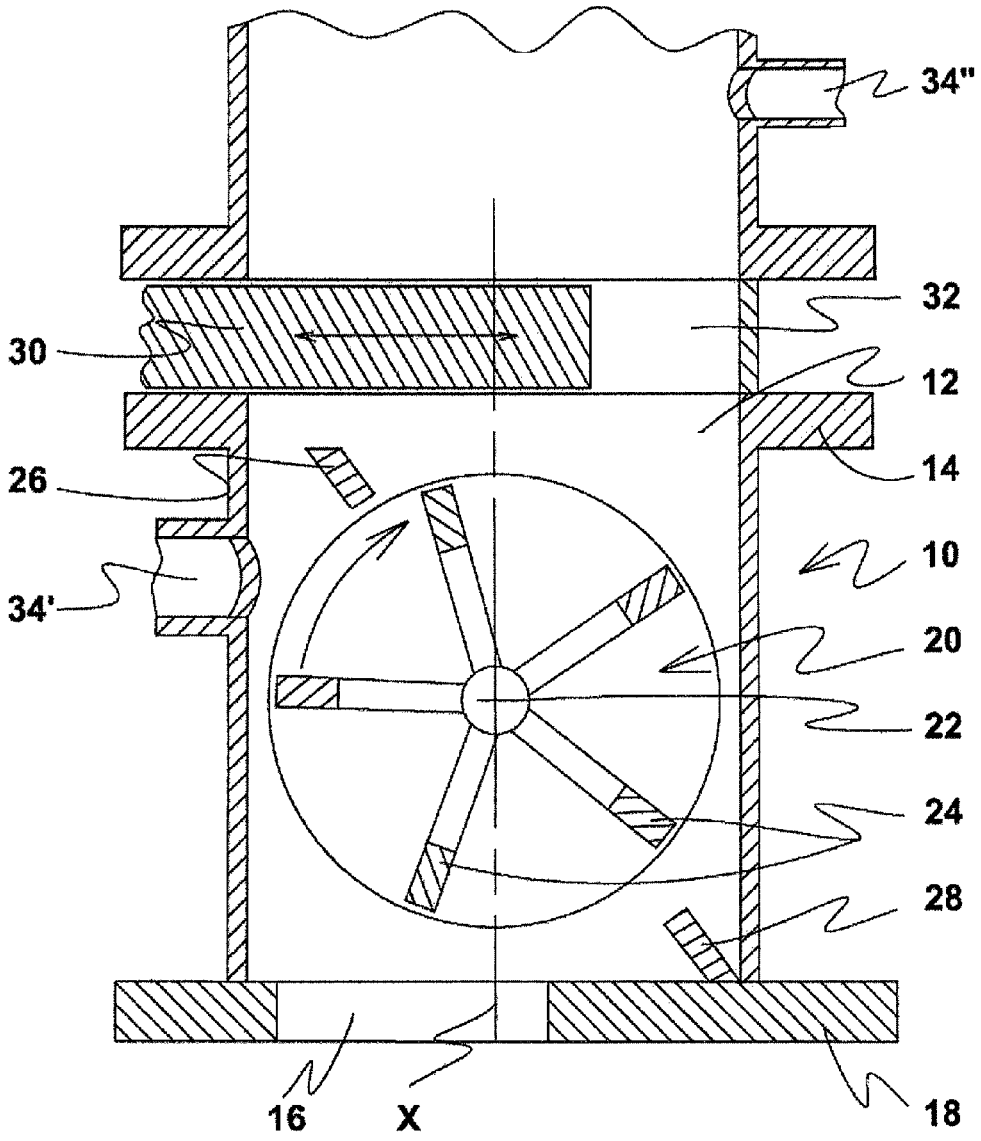
FIG. 1 illustrates a prior art mixing device.

FIG. 1 shows an apparatus in accordance with a prior art i.e. in accordance with U.S. Pat. No. 6,193,406. The apparatus comprises a casing 10, which in its simplest form is cylindrical in the direction of flow of the medium, but it may also be cylindrical in the direction of the rotor axis. The casing 10 is provided with an inlet 12 and an outlet 16, with flanges 14 and 18, respectively, the outlet being preferably tangential to the direction of rotation of the rotor, and with a rotor 20 arranged rotatably within the casing 10. The mixer is attached by means of its flange 14 to a so-called inlet piping, i.e., the flow channel of the incoming fiber suspension, and by means of its flange 18 to a so-called outlet piping, i.e. the flow channel of the fiber suspension being discharged from the mixer. The rotor 20 is formed of a shaft 22 mounted on bearings to a wall of the casing 10, the shaft being preferably perpendicular to the axis X of the casing 10. At least two blades 24 are attached to that end of the shaft 22, which extends to the inside of the casing 10, so that an open space remains in the center of the rotor 20 when the blades 24 rotate. The rotor is here provided with five blades 24, and they are substantially rectangular in cross section while the main axis of the cross-section is radial. The most essential thing, with regard to the shape of the blades is, however, that it makes the rotor rotate and also brings about the desired mixing effect. The casing may also be provided with ribs 26 and 28, which, together with the rotor 20, cause a turbulence, which brings about an adequate mixing effect in the suspension flow. The rib 26 is so arranged in connection with the inlet 12 that it directs the axial flow from the inlet 12 to the casing 10 non-centrally, thereby ensuring rotation of the rotor 20. In other words, besides a bevel guide member, as in FIG. 1, rib 26 may also be, e.g., a plate disposed perpendicularly to the axis of the flow path, covering part of the flow path. The most essential thing is that the member deviates the mass center of the flow from the axis of the flow channel. FIG. 1 further illustrates how the mixer casing is provided with a control valve 30, either as an integral part of the mixer or, alternatively, arranged in connection with the mixer flange 14. One task of the valve 30 is naturally to control the flow, whereby locating the rotor 20 near the valve 30 also contributes to the operation of the valve 30, ensuring that fibers cannot adhere to the gate or other valve member and thereby gradually cause the valve opening 32 to become clogged. Another task of the valve 30 is essential to the mixer; namely, to direct the flow along a sidewall of the inlet into the mixer casing 10. And finally, FIG. 1 also illustrates how either the mixer casing 10 or the inlet piping may be provided with a conduit 34', 34" for adding a chemical, dilution liquid, steam, or other material to the flow.

Figure 2:
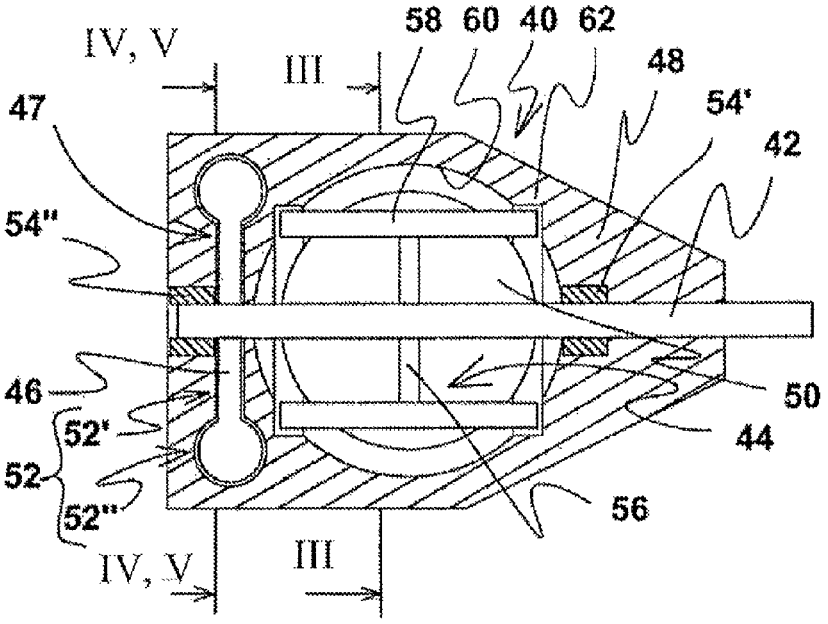
FIG. 2 illustrates a first preferred embodiment of the present invention as a cross-section along the axis of the rotor shaft.

FIG. 2 illustrates a dynamic mixer 40 in accordance with a first preferred embodiment of the present invention cut along the mixer axis. The mixer 40 has a shaft 42 with mixing elements 44, forming the mixer rotor, and turbine vanes 46, forming the turbine wheel 47, attached thereon. The shaft 42, the elements 44 and the vanes 46 have been arranged in a housing 48 having a mixing chamber 50 for the mixing elements 44, and turbine chamber 52 for the turbine vanes 46. In this embodiment the two chambers 50 and 52 have been arranged axially side by side. In the illustrated embodiment the housing 48 has been provided with bearings and sealings 54', 54" for the shaft 42 at the outer sides of the mixing and turbine chambers 50 and 52, respectively. Naturally, it is also possible to arrange at least a sealing between the mixing chamber 50 and the turbine chamber 52 if such is considered necessary. In case the mixer 40 is a small one it is also possible to arrange the bearings and the sealing 54' to one side of the housing 48 only (possibly to the right hand side of the housing 48 in the mixer 40 of FIG. 2).

The mixing chamber 50 has, in this embodiment, a round cross-section. However, the general shape of the mixing chamber may vary a great deal; it may be of cylindrical shape, or of some other appropriate shape. In some cases, where a very efficient mixing is required, it is important that the mixing chamber as well as the rotor rotating in the chamber is symmetrical in relation to the vertical plane (so called centerline plane) drawn (the axis of the rotor being horizontal and running via the center of the housing) via the center of the housing.

The mixing elements 44 are, in this embodiment, formed of substantially radial arms 56 attached on the shaft 42, and substantially axially extending blades 58 arranged at the distal ends of the arms 56. In the embodiment of FIG. 2 there is only one arm 56 per one blade 58, the arm 56 being positioned preferably in the above defined centerline plane. However, it is also possible to arrange two, or more, arms per each blade. Preferably, the positioning of the arms is, again, symmetrical along the guidelines set above. The cross-sectional shape of the arms and blades may be chosen freely. For instance, patent documents EP-B1-0664150 and EP-B1-1755774 discuss in more detail the cross-section of the blades. The configuration of the blades may be straight as shown in FIG. 2, but it may as well be curved or chevron shaped as discussed in EP-A1-1755774. Also, the shaft may either have a uniform diameter over the entire length thereof (as shown in FIG. 2), or the diameter of the shaft may also change as shown in EP-A1-1755774.

FIG. 2 shows also how the inner wall 60 of the mixing chamber 50 is provided with recesses 62 for the ends of the mixing blades 58. Naturally also other options exist. The blades 58 may terminate at an appropriate distance from the inner wall 60 of the mixing chamber 50, and/or the ends of the blades 58 may be formed to follow the contour of the inner wall 60 at a short distance.

The turbine chamber 52 is, in the embodiment shown in FIG. 2, located at a side of the mixing chamber, and formed of a substantially narrow first part 52' radially closer to the shaft 42, and an annular wider second part 52" farther away of the shaft 42. The second part 52" has, here, a round cross-section. The turbine chamber 52 is provided with turbine vanes 46 attached on the shaft 42. The shape of the vanes 46 conforms to the cross-sectional shape of the first and second chamber parts 52', 52" with, naturally, a sufficient running clearance.

Figure 3:
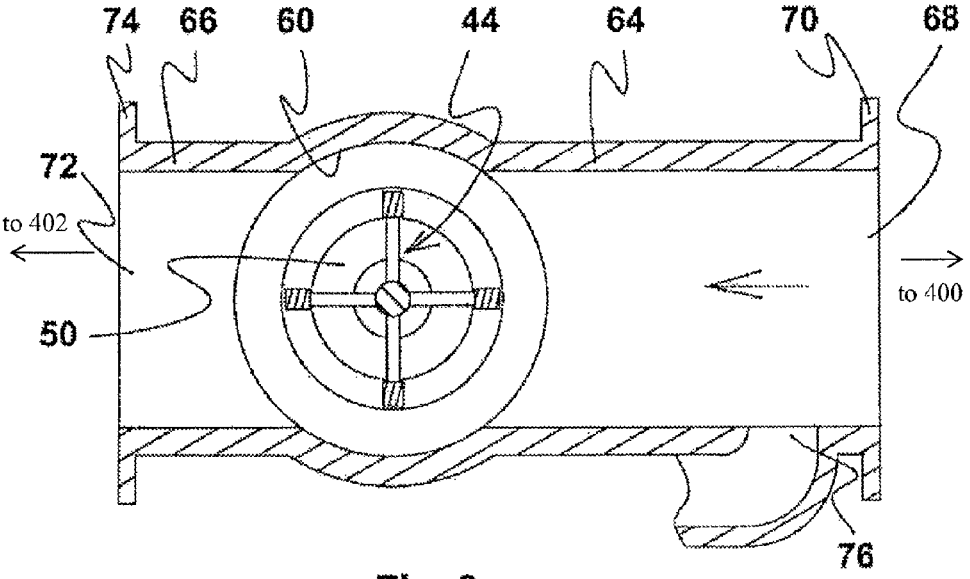
FIG. 3 illustrates the first preferred embodiment of the present invention cut along line III-III of FIG. 2.

FIG. 3 illustrates a cross-section taken along line III-III of FIG. 2, i.e. along the centerline of the housing. FIG. 3 shows the inlet and the outlet channels 64 and 66, respectively, of the mixer 40 arranged at the opposite longitudinal ends of the housing 48. The inlet channel 64 has an inlet opening 68 surrounded by a flange 70 for attaching the mixer 40 to the pipeline 400 bringing the process flow i.e. the liquid medium from an earlier process step. The pipeline 400 is separate from and fluidly isolated from the turbine chamber 52. In a similar manner the outlet channel 66 has an outlet opening 72 surrounded by a flange 74 for attaching the mixer 40 to the pipeline 402 taking the process flow i.e. the mixture of the liquid medium and the fluid mixed therewith further in the process. In the FIG. 3 embodiment the mixing chamber 50 is positioned closer to the outlet opening 72 of the mixer 40, as the housing 48 is provided, at the inlet channel 64 thereof, with at least one inlet opening 76 for the fluid to be mixed with the medium flowing into the mixing chamber 50 along the inlet channel 64. The mixing chamber 50 has, also in this cross-section, a round shape, which means that the mixing chamber is basically ball-shaped. However, the shape of the mixing chamber is not essential for the working of the invention, whereby the shape may be any one desired. The mixer rotor has, in this embodiment, four sets of mixing elements 44. However, the number of elements is not critical, but can be chosen freely to meet the demands of the fluids and mediums to be mixed. In a similar manner, if considered important, the inner wall 60 of the mixing chamber 50 may be provided with one or more ribs or other elements for increasing the turbulence.

Figure 4:
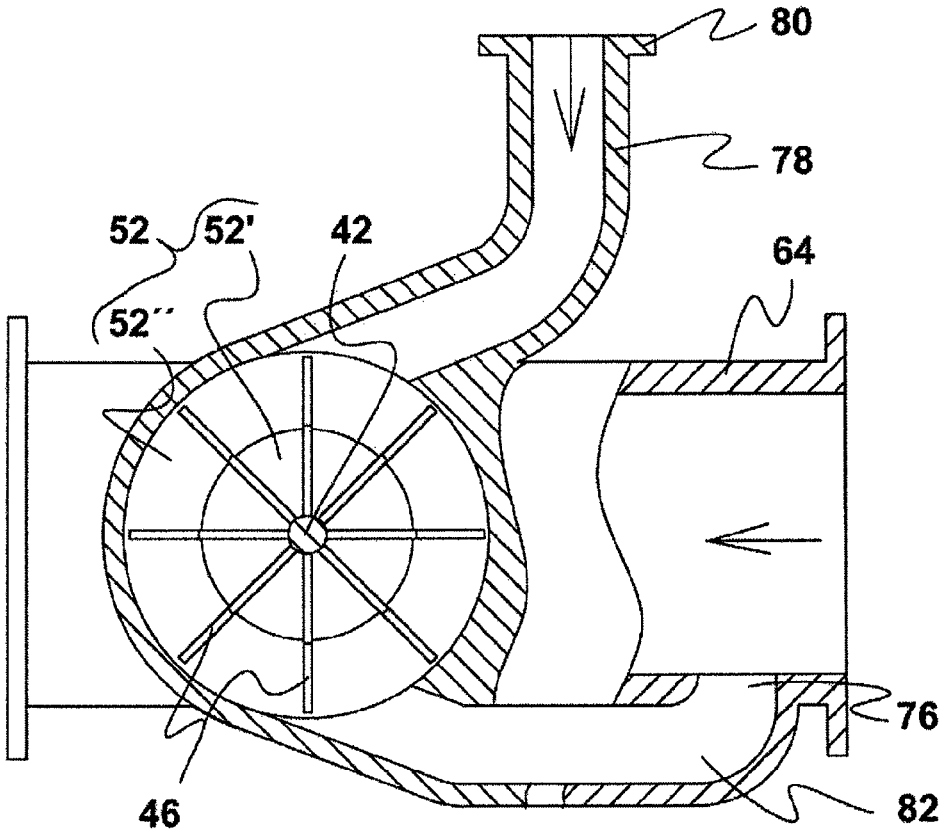
FIG. 4 illustrates the first preferred embodiment of the present invention cut along line IV-IV of FIG. 2.

FIG. 4 illustrates a cross-section taken partially along line IV-IV of FIG. 2, and partially along the centerline of the housing. In other words, FIG. 4 shows in more detail the structure of a preferred embodiment of the turbine chamber 52 having a radially inner part 52' and a radially outer part 52". As shown the turbine chamber 52 has, for the fluid to be mixed, an inlet conduit 78 initiating from a flange 80, and an outlet conduit 82 terminating in the outlet opening 76 in the wall of the inlet channel 64 of the mixing chamber. The mixing chamber is positioned behind the turbine chamber 52 such that the mixer rotor is attached on the same shaft 42 with the turbine wheel. The turbine chamber 52 surrounds a turbine wheel having, in this embodiment, eight substantially radial turbine vanes 46. The number of the vanes 46 as well as the size of the turbine chamber 52 in relation to the mixing chamber may vary significantly, depending mostly on the size of the apparatus, on the properties of the drive fluid rotating the turbine wheel, on the amount of drive fluid flow into the turbine, on the properties of the liquid medium in which the fluid is supposed to be mixed, and on the pressure and speed of the in-coming drive fluid flow. Both the inlet and outlet conduits 78 and 82, respectively, are preferably arranged tangentially to the outer circumference of the turbine chamber 52 i.e. in flow communication with the outer chamber part 52", so that the kinetic energy of the flow can be utilized as effectively as possible. The right hand side of the drawing shows the cross-section along the axis of the mixing chamber, or the inlet channel 64 for the part where the outlet conduit 82 terminates in the opening 76 in the inlet channel 64 of the mixer. In other words, the opening 76 can be, in this embodiment, called simultaneously as the outlet opening for the drive fluid and as the inlet opening for the fluid to be mixed.

The operation of the mixer in accordance with the first preferred embodiment of the present invention is explained here in more detail by referring to the mixer of FIGS. 2, 3 and 4. The operation is based on the idea that the fluid to be mixed with the main flow i.e. with the liquid medium rotates the mixer rotor in the mixing chamber 50. The desired function has been accomplished by directing the drive fluid flow along the inlet conduit 78 towards the vanes 46 of the turbine wheel in the turbine chamber such that the motive force of the fluid makes the turbine wheel rotate in the turbine chamber 52. Since both the turbine wheel and the mixer rotor are fastened on the same shaft 42, or at least arranged in operative communication with each other by means of a gear, the rotation of the turbine wheel makes the mixer rotor rotate. For the mixer to function in a desired manner the velocities and the pressures of the drive fluid in the outlet conduit 82 and the liquid medium in the inlet channel 64 have to meet some requirements. Both the velocity and the pressure of the drive fluid guided in the turbine chamber 52, and more specifically in the outlet conduit 82 thereof have to be higher than that of the main flow. How much higher, depends on a number of factors, i.e. the densities of the drive fluid and the medium, the viscosity of the drive fluid and the liquid medium, the amount of drive fluid in relation to the amount of main flow (liquid medium), the desired mixing efficiency, the desired speed of rotation of the rotor, just to name a few factors.

Figure 5:
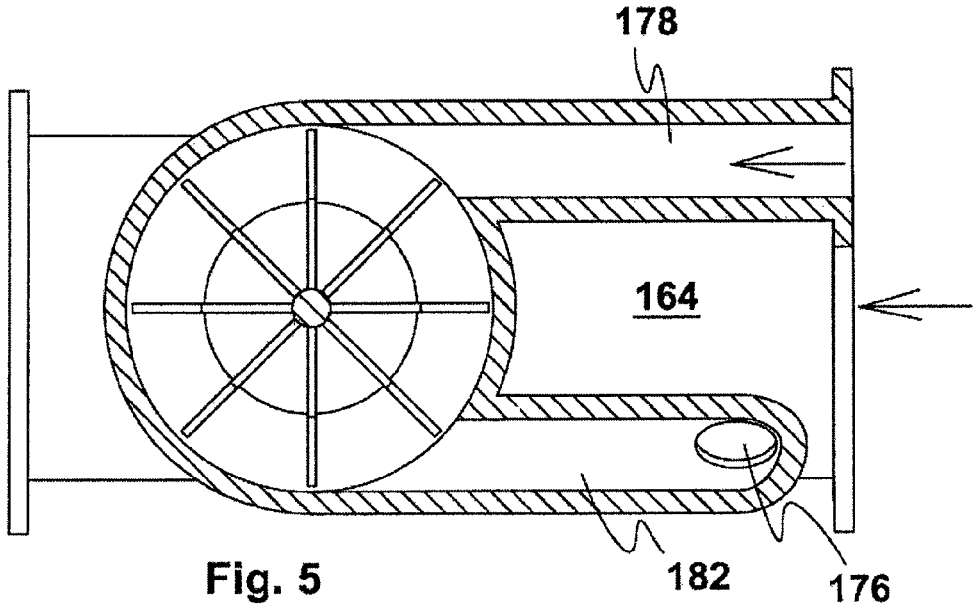
FIG. 5 illustrates a partial cross-section of a second preferred embodiment of the present invention cut along line V-V of FIG. 2.

FIG. 5 illustrates a second preferred embodiment of the invention. The major difference to the FIG. 4 embodiment is the arrangement of the inlet and outlet conduits 178 and 182, respectively, of the turbine chamber. In the embodiment of FIG. 5 the inlet conduit 178 and the outlet conduit 182 are substantially parallel whereby the in-coming drive fluid effectively rotates the turbine wheel for the full 180 degrees, whereas in the embodiment of FIG. 4 the corresponding angular value was on the order of 140 degrees. Naturally, the angular value could be even increased from the 180 degrees value by bringing the inlet and outlet conduits closer to each other, if such is needed or desired.

Figure 6:
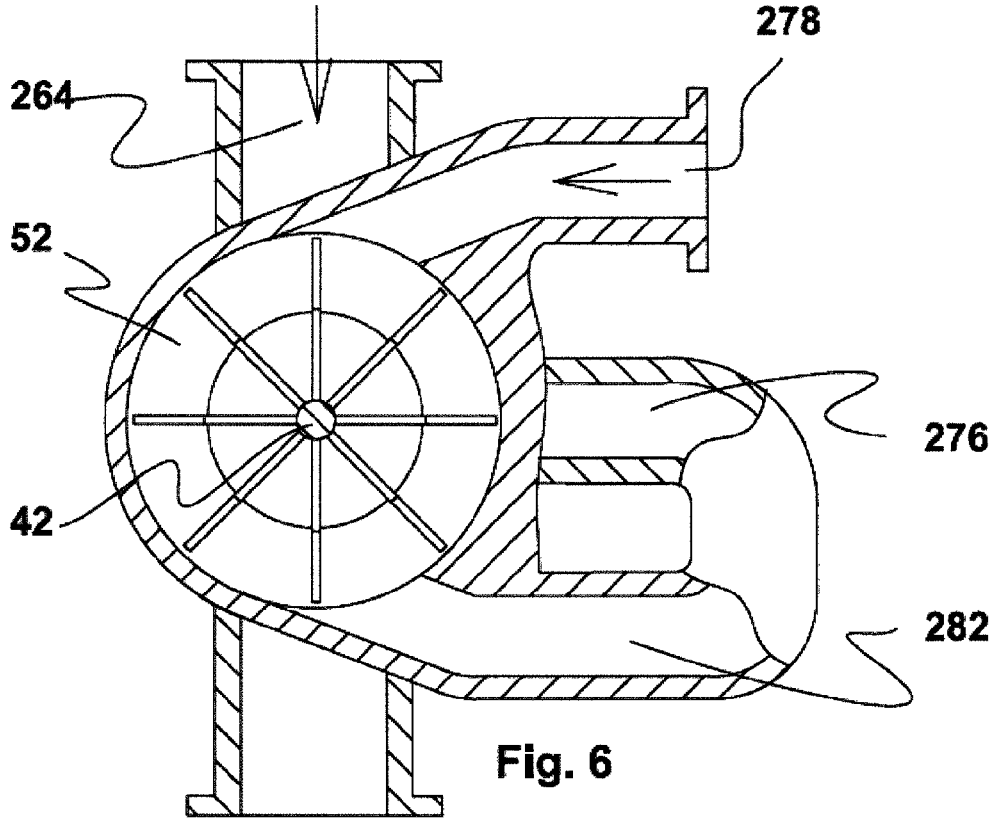
FIG. 6 illustrates a partial cross-section of a third preferred embodiment of the present invention

FIG. 6 illustrates a third preferred embodiment of the present invention, i.e. yet one more optional arrangement to introduce the drive fluid into the liquid medium flow. Process wise this embodiment is similar to the ones discussed in FIGS. 4 and 5. The only exception is that now the drive fluid is introduced directly into the mixing chamber (situated behind the turbine chamber 52 such that the mixer rotor is attached on the same shaft 42 with the turbine wheel), and not into the inlet channel 264 leading thereto. The easiest way to arrange this is to provide both the outlet conduit 282 of the turbine chamber 52, and the inlet conduit 276 of the mixing chamber with flanges to which an appropriate U-pipe is attached.

For instance, if the drive fluid is medium pressure steam, and the liquid medium is fiber suspension of pulp and paper industry, the steam has well enough pressure to make the mixer rotor rotate. Especially, as the speed the rotor should rotate is not high. Even a slow rotation of the mixer rotor prevents the channelling of the steam in the pulp flow and enhances the condensing of the steam in the pulp.

Figure 7:
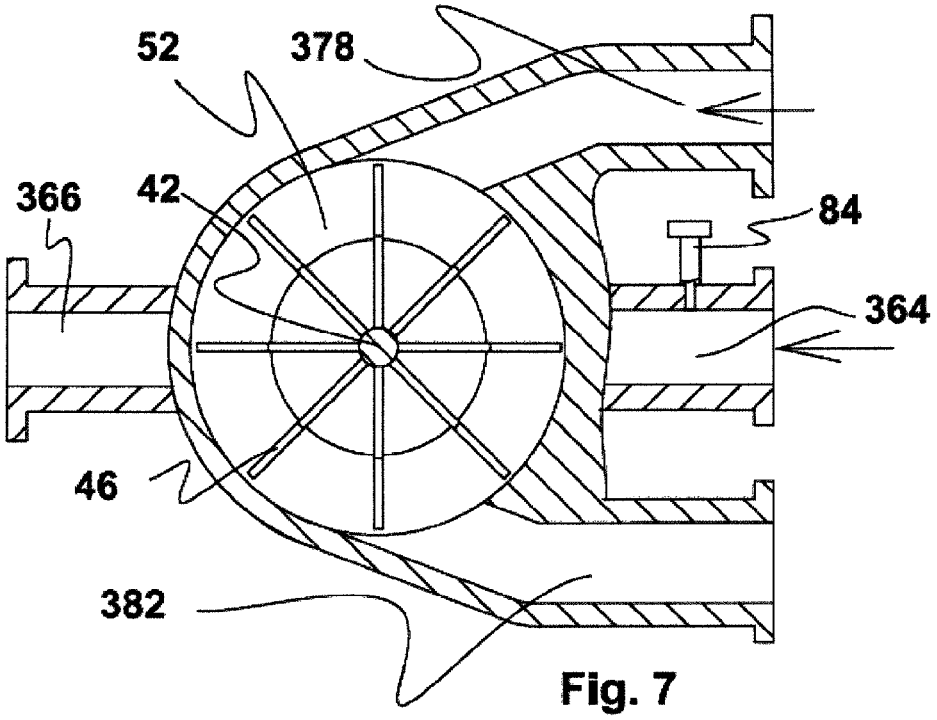
FIG. 7 illustrates a fourth preferred embodiment of the present invention cut along the axis of the mixing device.

In the embodiments discussed above the drive fluid rotating the mixer rotor has been the fluid which is supposed to be mixed with the liquid medium in the mixer. Two more options to arrange the drive fluid flow has been discussed in connection with FIG. 7 where the turbine chamber 52 is, again, in operative communication with the mixing chamber (not shown, but situated, in the drawing, behind the turbine chamber) having a mixer rotor arranged on the same shaft 42 with the turbine wheel and positioned axially at a side of the turbine chamber. In a fourth preferred embodiment of the present invention the drive fluid is introduced into the inlet conduit 378 along which it flows to the turbine chamber 52, rotates the turbine wheel represented by the turbine vanes 46, which imparts a rotation to the mixer rotor, and is removed from the turbine chamber along outlet conduit 382. In this embodiment neither the inlet conduit 378 nor the outlet conduit 382 are in any communication with the liquid medium flow path that includes the inlet and outlet channels, 364 and 366 respectively, and the mixer chamber therebetween. In addition to the liquid medium and the drive fluid flow channels and conduits FIG. 7 also shows by reference numeral 84 an inlet for the chemical or other substance to be mixed with the liquid medium. The inlet 84 is naturally arranged either, as shown in FIG. 7, upstream of the mixing chamber in the wall of the inlet channel 364, or in the wall of the mixing chamber. The drive fluid may be any third fluid, which is only used, since it is available. In other words, the drive fluid is neither the fluid to be mixed nor the liquid medium into which the fluid is supposed to be mixed. As an example of this embodiment, steam that is flowing towards a heat exchanger, or some other position, could drive a mixer that is used for mixing chlorine dioxide into fiber suspension.

However, the fourth embodiment of FIG. 7 may, as an example, be varied to incorporate a fifth preferred embodiment of the present invention such that the two lowermost flanges (at the end of the inlet channel 364, and in the outlet conduit 382) at the right hand side of the drawing are united by means of a U-pipe, which results in an operation where the drive fluid running the turbine wheel is the liquid medium into which the fluid or chemical from inlet 84 is supposed to be mixed. In other words, the motive force of the liquid medium itself is used to effect the mixing of the fluid into the liquid medium. In a way, the function resembles the operation of a static mixer, but is much more effective.

Figure 7A:
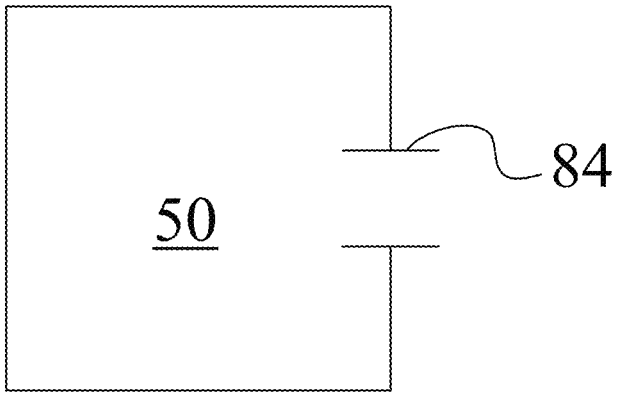
FIG. 7A illustrates, in highly simplified, schematic form, an alternative arrangement to the fourth embodiment as illustrated in FIG. 7.

As to the inlet 84 it should be understood that one or more such fluid inlets could be arranged in connection with any embodiment of the present invention. The position of the inlet is preferably either in the wall of the inlet channel 364 of the mixing chamber 50 (FIG. 7) or in the wall of the mixing chamber 50 (shown in highly simplified schematic form in FIG. 7A). Thus it is clear that the existence of the one or more fluid inlets offers a possibility to introduce one or more fluids or chemicals into the liquid medium flow either in addition to the drive fluid introduced via a route of its own or as the sole fluid/s or chemical/s to be introduced.

A one more structural alternative concerning the use of, for instance, steam, or dilution liquid as the drive fluid could be discussed as a preferred embodiment of the present invention. The above discussed embodiments teach the use of separate conduits for introducing the drive fluid into the liquid medium either in the inlet channel of the mixing chamber or in the mixing chamber itself. However, there is another alternative, especially, when the turbine and mixing chambers are arranged side by side. The two chambers may be connected by means of an internal conduit that is either dimensioned such that an appropriate amount of drive fluid enters the liquid medium or provided with valve means to adjust the amount of drive fluid entering the liquid medium. In other words, it is possible to divide the drive fluid into two parts, one entering the liquid medium, and the other flowing further in the process.

In view of above, it is clear that the turbine may be positioned in whichever position close to the mixing chamber so that the only two requirements for their mutual arrangement are, that the turbine chamber is situated at a side of the mixing chamber such that the turbine wheel does not interfere the mixing, and that the shaft carrying both the mixer rotor and the turbine wheel should run through the centers of the both chambers. In this connection it could, however, be mentioned as another option that, if desired, a gear, preferably a reduction gear may be arranged between the turbine wheel, and the mixer rotor whereby the requirement concerning a single or common shaft may be forgotten. Thus also the mutual arrangement of the chambers may be more freely chosen, as the chambers need not be arranged on the same axis. By using a gear the rotational speed of the mixer rotor could be lower, or, if desired, also higher, than the one of the turbine wheel.

It is thus understood that the preferred embodiments illustrated and described above are for illustrative purposes only and are not to be considered as limiting the scope of the invention, which is properly delineated only in the appended claims. In view of the above description it should be understood that the mixer may be provided with power drive means in addition to the turbine discussed in the above specification. However, due to the existence of the turbine the power consumption of the power drive means is far lower than without the turbine means of the invention. In view of the above description it should also be understood that the phrase 'liquid medium' covers all flowable media that include liquid as one or the only component of the medium. In other words, the liquid medium may contain mostly air, mostly dry matter as well as mostly water or other liquid.

The invention claimed is:

1. An apparatus for mixing a second fluid into a first fluid, said apparatus comprising:

a housing comprising a mixing chamber and a turbine chamber, wherein the turbine chamber is separate from said mixing chamber;

the mixing chamber comprising:

an inlet channel with an inlet opening, wherein the inlet opening is configured for the first fluid to be introduced into the inlet opening from a pipeline, wherein the pipeline is separate from and fluidly isolated from the turbine chamber;

an outlet channel with an outlet opening for a mixture of said first fluid and said second fluid; and a mixer rotor disposed in the mixing chamber;

the turbine chamber comprising:

an inlet conduit for the second fluid;

a turbine wheel disposed in the turbine chamber, wherein the turbine wheel is separate from and operatively connected with said mixer rotor such that rotation of the turbine wheel is transferred to the mixer rotor; and an outlet conduit for the second fluid, configured to introduce the second fluid into one of the mixing chamber and the inlet channel;

the turbine chamber being configured such that, as the second fluid enters the inlet conduit, a motive force of the second fluid rotates the turbine wheel without directly rotating the mixer rotor;

and the operative connection between the turbine wheel and the mixer rotor being configured such that the rotation of the turbine wheel, caused by the motive force of the second fluid, is transferred to the mixer rotor.

2. The apparatus as recited in claim 1, wherein the turbine chamber is disposed at a side of the mixing chamber.

3. The apparatus as recited in claim 1, wherein the outlet conduit is in fluid communication with the inlet channel.

4. The apparatus as recited in claim 1, further comprising at least one inlet for introducing a chemical or an additional fluid, wherein the inlet is disposed in one of the mixing chamber or the inlet channel.

5. The apparatus as recited in claim 1, wherein the operative connection between the turbine wheel and the mixer rotor comprises at least one member of the group consisting of:

the turbine wheel and the mixer rotor being disposed on a common shaft; and a geared connection between the turbine wheel and the mixer rotor.

6. A method of mixing a second fluid into a first fluid in an apparatus, the apparatus comprising:

a housing comprising a mixing chamber and a turbine chamber in operative communication with said mixing chamber;

the mixing chamber comprising:

an inlet channel with an inlet opening, wherein the inlet opening is configured for said first fluid to be introduced into the inlet opening from a pipeline, wherein the pipeline is separate from and fluidly isolated from the turbine chamber;

an outlet channel with an outlet opening for a mixture of said first and said second fluid; and a mixer rotor disposed in the mixing chamber;

the turbine chamber comprising an inlet conduit for the second fluid, and a turbine wheel; said turbine wheel being connected operatively to said mixer rotor;

the method comprising:

introducing said first fluid into said mixing chamber from said pipeline;

introducing said second fluid into said turbine chamber to thereby rotate said turbine wheel by a motive force of said second fluid, so that the rotation of the turbine wheel imparts rotation to the mixer rotor thereby affecting the mixing of the second fluid into said first fluid;

discharging said second fluid from said turbine chamber to an outlet conduit;

introducing said second fluid from said outlet conduit into one of said mixing chamber and said inlet channel; and mixing said first fluid and said second fluid in said mixing chamber; wherein the turbine chamber is separate from the mixing chamber, wherein the turbine wheel is disposed in the turbine chamber, wherein the turbine wheel is separate from the mixer rotor, and wherein the motive force of the second fluid rotates the turbine wheel without directly rotating the mixer rotor.

7. The method as recited in claim 6, wherein said first fluid is a fiber suspension of pulp and paper industry.

8. The method as recited in claim 6, wherein said second fluid is a liquid or gaseous chemical or steam used in pulp and paper industry.

* * * * *